US006170115B1

(12) United States Patent
Tanaka et al.

(10) Patent No.: US 6,170,115 B1
(45) Date of Patent: Jan. 9, 2001

(54) CLEANING TAPE FOR PHOTOGRAPHIC MATERIAL TRANSPORTING ROLLERS

(75) Inventors: Naomitsu Tanaka, Ibaraki; Shinji Narukami, Wakayama, both of (JP)

(73) Assignees: Nitto Denko Corporation, Ibaraki (JP); Noritsu Koki Co., Ltd., Wakayama (JP)

( * ) Notice: Under 35 U.S.C. 154(b), the term of this patent shall be extended for 0 days.

(21) Appl. No.: 09/229,309

(22) Filed: Jan. 13, 1999

(30) Foreign Application Priority Data

Jan. 14, 1998 (JP) ..... 10-005843

(51) Int. Cl.[7] ..... A47L 25/00

(52) U.S. Cl. ..... 15/210.1; 360/128; 428/77; 428/196; 428/201

(58) Field of Search ..... 15/210.1, DIG. 12; 360/128; 428/196, 201, 77

(56) References Cited

U.S. PATENT DOCUMENTS

| | | |
|---|---|---|
| 3,789,452 | 2/1974 | Nemoto . |
| 4,408,241 | 10/1983 | Ogawa . |
| 5,223,329 | 6/1993 | Amann . |

FOREIGN PATENT DOCUMENTS

| | | |
|---|---|---|
| 2078558 | 1/1982 | (GB) . |
| 97/10596 | 3/1997 | (WO) . |

*Primary Examiner*—Alexander S. Thomas
(74) *Attorney, Agent, or Firm*—Wenderoth, Lind & Ponack, L.L.P.

(57) ABSTRACT

A cleaning tape for use in cleaning transporting surfaces of transporting rollers arranged along a photographic material transporting passageway includes a tape body provided on at least one side thereof with an adhesive layer spaced a distance away from one lengthwise end therteof. A porous screen is laid on the adhesive layer.

4 Claims, 6 Drawing Sheets

CLEANING TAPE FOR PHOTOGRAPHIC MATERIAL TRANSPORTING ROLLERS

BACKGROUND OF THE INVENTION

1. Field of the Invention

The present invention relates to a cleaning tape for use in cleaning photographic material transporting rollers in a photographic processor.

2. Description of the Prior Art

In general, a number of paired transporting rollers, composed of drive side transporting rollers and driven side transporting rollers press-contacted with the drive side transporting rollers, are arranged along a transporting passageway of a negative film or a photographic (printing) paper in the photographic processor so that the negative film or photographic paper can be transported along the transporting passageway. In this photographic processor, when the transporting rollers are contaminated by contaminants, such as dirt, built up thereon, the transporting rollers slip against the photographic material. As a result, the transport of the photographic material cannot be performed with accuracy.

For avoidance of this problem, various cleaning methods are proposed. One typical prior cleaning method is that the transporting rollers in the photographic processor are cleaned out with separately prepared waste. This cleaning method however is poor in workability in requiring that, after operation of the photographic processor is stopped, the transporting rollers in the photographic processor are cleaned out manually from a handhole of the processor.

There is proposed another cleaning method in which a tape having on one side surface thereof a liquid absorbing layer of a non-woven fabric impregnated with a solvent such as acetone or alcohol is passed through the pairs of transporting rollers to clean out the contaminants on the transporting rollers by means of the liquid absorbing layer impregnated with the solvent. This cleaning method however sometimes causes problems in that sensors are contaminated by the solvent with which the liquid absorbing layer is impregnated and in that the working environment becomes worse by evaporation of the solvent.

There is proposed still another cleaning method in which a tape, simply having an adhesive layer, on an adhesive layer, one side surface thereof is passed through the pairs of transporting rollers to transfer the contaminants on the transporting rollers to the adhesive layer. This cleaning method of however involves problems in that the adhesive layer sometimes adheres to not only the transporting rollers, but also other parts, accidentally, so that the tape is captured by them. As a result of this, smooth cleaning is hindered so as to inevitably produce reduced efficiency of the cleaning.

SUMMARY OF THE INVENTION

In the light of these circumstances, the present invention has been made. It is the object of the invention to provide a cleaning tape capable of reliably cleaning out contaminants on the transporting rollers of the photographic processor with efficiency and without being rolled into the transporting rollers.

To achieve the above object, the present invention provides a cleaning tape for use in cleaning transporting surfaces of transporting rollers arranged along a photographic material transporting passageway, wherein a tape body is provided on at least one side thereof with an adhesive layer, with a distance away from one lengthwise end thereof, and a porous screen is laid on the adhesive layer.

The cleaning tape of the invention is constructed such that when a surface of a portion of the tape body forming thereon the adhesive layer is in a non-pressurized state, the porous screen protrudes from a surface of the adhesive layer so that the cleaning tape can show substantial non-tackiness, while on the other hand, when the surface of the portion of the tape body forming thereon the adhesive layer is in a pressurized state, the adhesive layer emerges from porous portions of the porous screen so that the cleaning tape can show substantial tackiness.

It is preferable that the entire length of the adhesive layer is set to such a length that the transporting rollers can turn not less than one turn.

Further, it is preferable that a ratio (S1/S2) of an area S1 of exposed surfaces of the adhesive layer emerged from the porous portions of the porous screen and an area S2 of part of the adhesive layer on which the porous screen is provided is in the range of from 50/1 to 1/10.

DETAILED DESCRIPTION OF THE EMBODIMENT

Referring now to the accompanying drawings, examples of the preferred embodiments of the present invention directed to a cleaning tape for photographic material transporting rollers will be described below. It is to be understood, however, that the scope of the invention is by no means limited to the illustrated embodiments.

Figure 1:
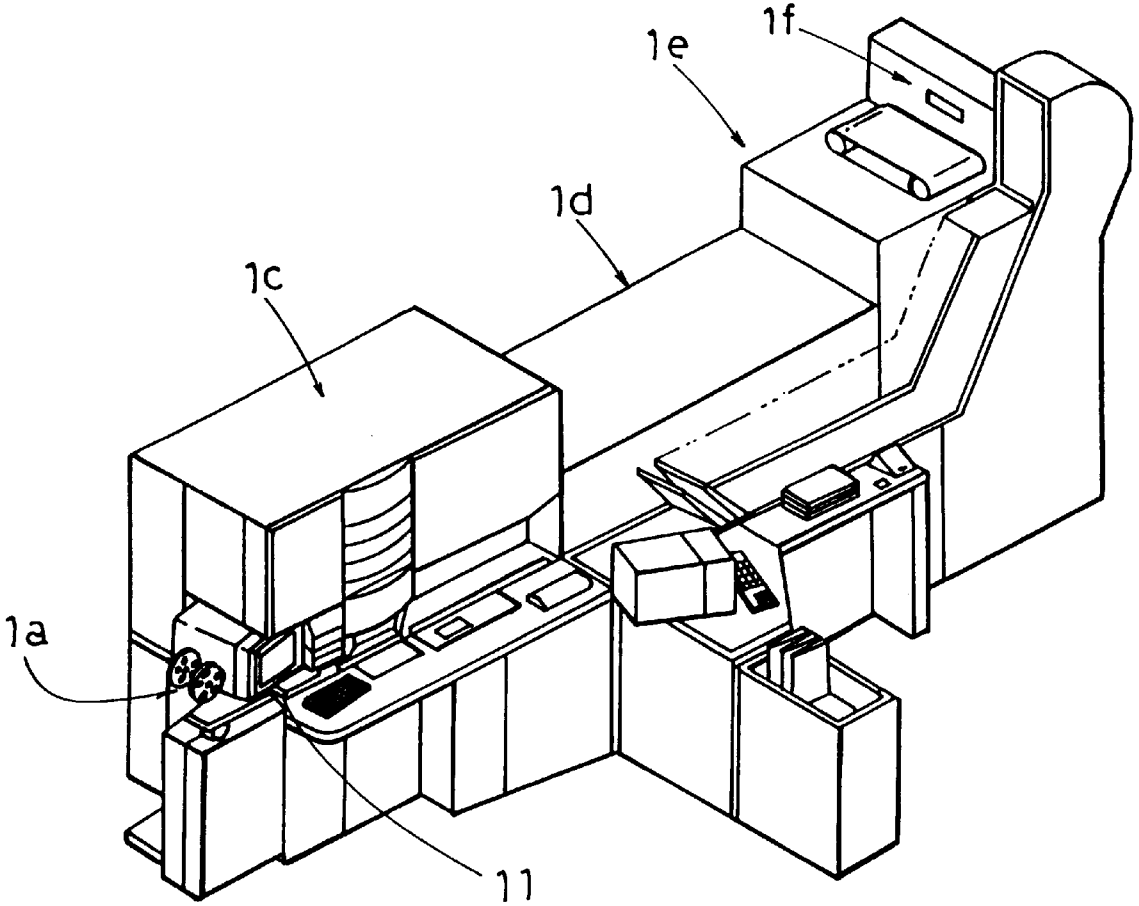
FIG. 1 is a schematic perspective view of a photographic processor.

FIG. 1 is a schematic showing of a photographic processor for use with the cleaning tape of the present invention. The photographic processor has a known structure, basically comprising a negative film feeding device 1*a*, an exposure device 1*c* for printing negative film images on a printing paper drawn out of a paper magazine 1*b*, a processor 1*d* for processing the printing paper exposed by the exposure device 1*c*, a drying device 1*e* for drying the processed printing paper, a print discharging device 1*f* for cutting the dried printing paper at predetermined lengths and discharging the as-cut printing papers as prints, and a negative film discharging device 1*g* for cutting the negative film used in the exposure device 1*c* and discharging the as-cut negative films.

Figure 2:
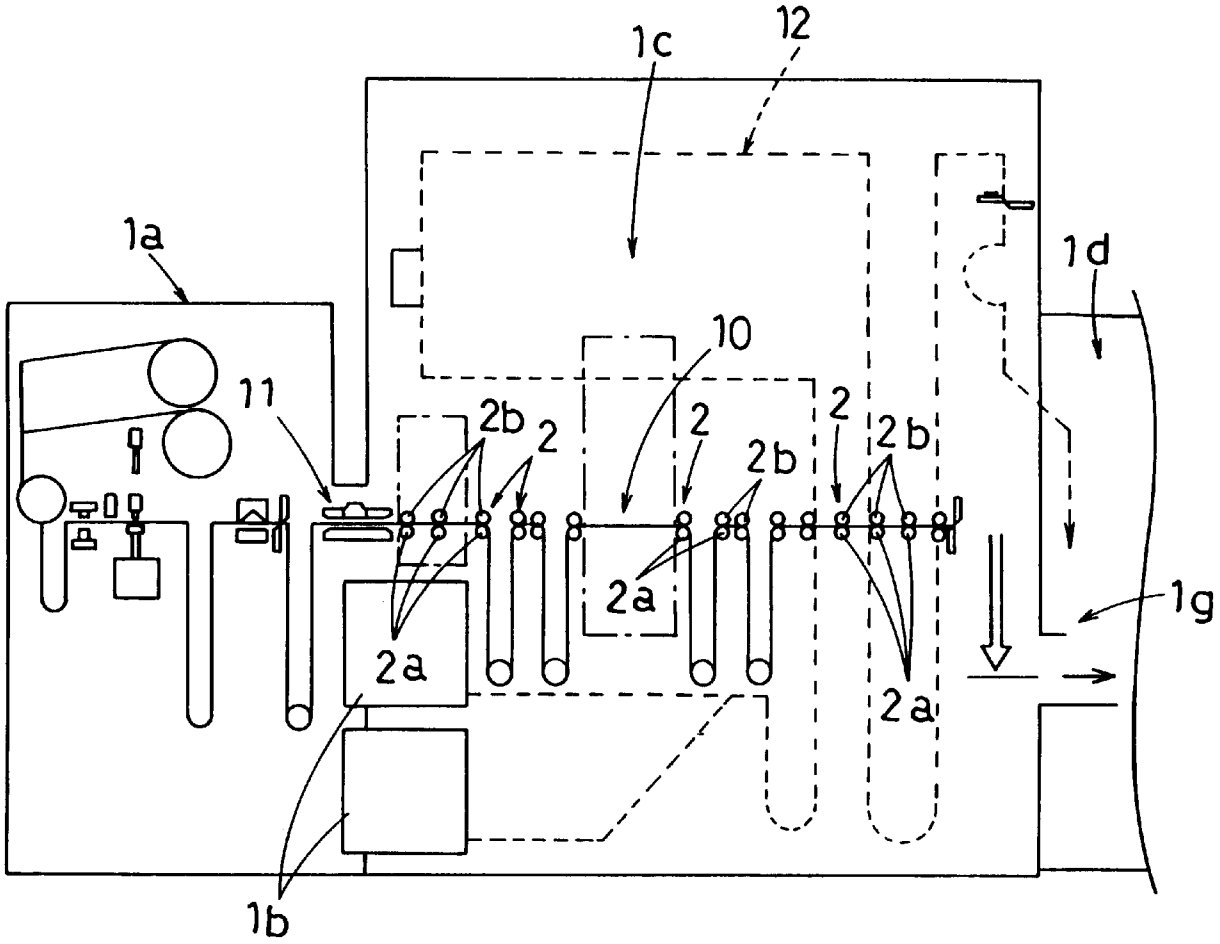
FIG. 2 is a schematic showing of a part of the photographic processor.
Figure 3:
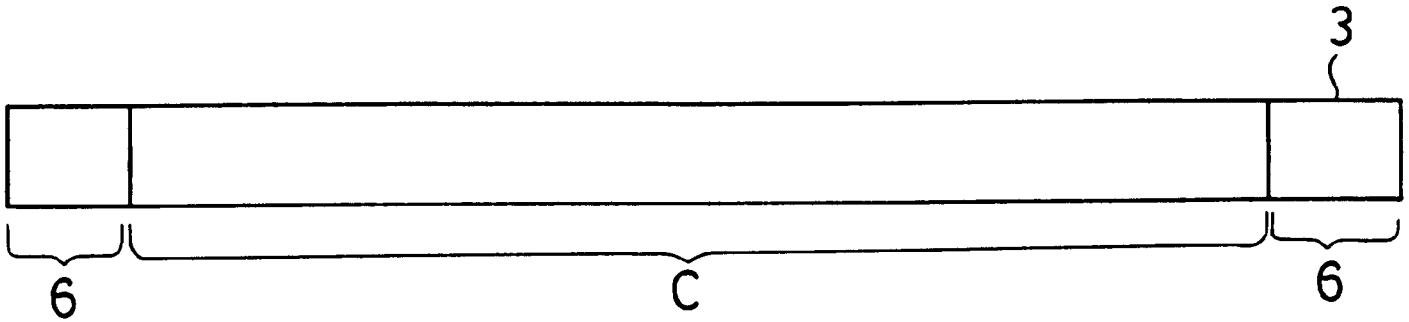
FIG. 3 is a schematic plan view of a cleaning tape according to the invention.

In the photographic processor, a number of paired transporting rollers 2, composed of drive side transporting rollers 2*a* and driven side transporting rollers 2*b*, press-contacted with the drive side transporting rollers 2*a*, are spaced at a predetermined interval along a negative film transporting passageway 10 extending from the negative film feeding device 1*a*through the exposure device 1*c* to the print discharging device 1*f*, as schematically shown in FIG. 2, so that the negative film can be transported along the transporting passageway 10 via the paired transporting rollers 2.

In the photographic processor, an intermediate insertion portion 11 from which a piece of developed film and the like is fed to a midpoint of the negative film transporting passageway 10 is arranged at the midpoint in the negative film transporting passageway 10 at the upstream side of the exposure device 1*c*. Also, a number of transporting rollers (not shown) are arranged along a photographic (printing) paper transporting passageway 12 extending from the paper magazine 1*b* through the exposure device 1*c* to the processor 1*d*.

Now, the preferred embodiments of the present invention directed to a cleaning tape for use in cleaning transporting surfaces of the paired transporting rollers 2 assembled in the photographic processor described above will be detailed below.

Shown in FIGS. 3 to 7 is a cleaning tape designed especially for cleaning the transporting rollers 2*a*, 2*b* arranged along the negative film transporting passageway 10 mentioned above. The cleaning tape basically comprises a tape body 3 having a predetermined length. The tape body 3 is formed from polyethylene terephthalate, having a thickness of 125 $\mu$m, a width of about 35 mm, an entire length of about 390 mm and having such elasticity in bending that it can be restored nearly perfectly to its original flat form from bending under use.

The tape body 3 may be formed from a plastic sheet of, for example, polypropylene or vinyl chloride, in addition to polyethylene terephthalate, a sheet of paper (a resin-impregnated paper, in particular), a sheet of synthetic paper, or laminated sheets thereof.

Though no particular limitation is imposed on the thickness of the sheet, the sheet usually has a thickness on the order of 12 $\mu$m to 2 mm, preferably on the order of 50 $\mu$m to 1.0 mm, in consideration of the hardness or equivalent for workability.

Adhesive layers 4, 40 of 25 $\mu$m in thickness (in thickness after being coated and dried) are applied on front and rear surfaces of a tape-like sheet 30 of 75 $\mu$m in thickness, about 35 mm in width and about 290 mm in entire length. A porous screen 5 is laid on the adhesive layer 4 at the front side of the sheet. The sheet 30 adheres on one side of the tape body 3 at a lengthwise center part thereof through the adhesive layer 40, without providing the adhesive layer 4 at both lengthwise end portions of the tape body 3. The end portions of the tape body 3 of which the adhesive layer 4 is not located are formed as roll-in preventing portions 6 for preventing the tape body 3 from being rolled into the transporting rollers 2*a*, 2*b* by the adhesion of the adhesive layer 4. Also, the portion of the tape body 3 on which the sheet 30 adheres is formed as a cleaning portion C.

An adhesive of the adhesive layers 4, 40 used is made by 90 parts by weight of 2-ethylhexyl acrylate, 10 parts by weight of acrylic acid and 300 parts by weight of ethyl acetate being mixed and copolymerized.

The materials which may be used for adhesive layers 4, 40 include synthetic rubbers including acrylic rubbers, styrene rubbers and silicon rubbers and natural rubbers, in addition to the one mentioned above. The adhesive layers should preferably have a thickness smaller than the porous screen 5, as described later, on the order of 10–50%. With an excessively large thickness of the adhesive layer 4, there is a fear of an overflow of the adhesive over the porous screen 5.

In the illustrated embodiment, the entire length of the adhesive layer 4 is set to such a length that the transporting rollers 2*a*, 2*b* can turn about 4 turns.

Figure 5:
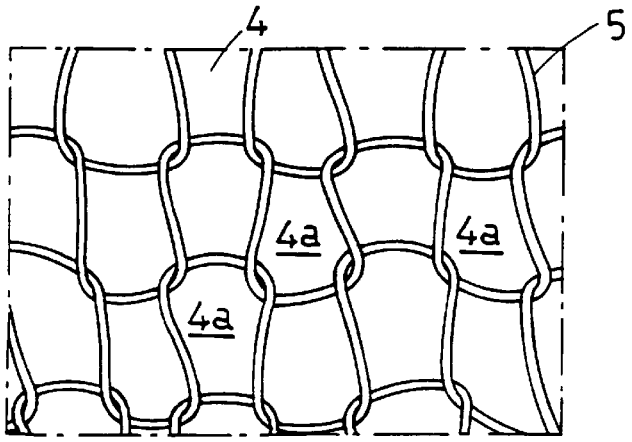
FIG. 5 is an enlarged view of the part of the same.
Figure 6:
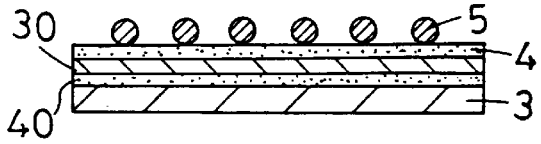
FIG. 6 is an enlarged sectional view of the same.

The porous screen 5 is made using a rough knitted fabric into which polyester fibers of 45 $\mu$m in thickness is knitted by plain knitting, as shown in FIG. 5. The porous screen 5 is adhesive bonded on the adhesive layer 4 by pressing with an iron roll with a temperature of 130° C. A ratio S1/S2 of an area S1 of the exposed surfaces 4*a* of the adhesive layer emerged from the porous screen 5 of the cleaning tape and an area S2 of part of the adhesive layer on which the porous screen 5 is adhesive bonded is set to be 3.8/1.

It is to be noted that the ratio S1/S2 of the area S1 of the exposed surfaces 4*a* of the adhesive layer and the area S2 of the part of the adhesive layer on which the porous screen 5 is adhesive bonded should be in the range of from 50/1 to 1/10, preferably from 20/1 to 1/5, further preferably from 10/1 to 1/3. With the ratio S1/S2 of more than 50, it is hard to ensure substantial non-tackiness in the non-pressurized state, as will be discussed later, while on the other hand, with the ratio of less than 1/10, it is hard for the tackiness to develop in the pressurized state, as will be discussed later.

Figure 8:
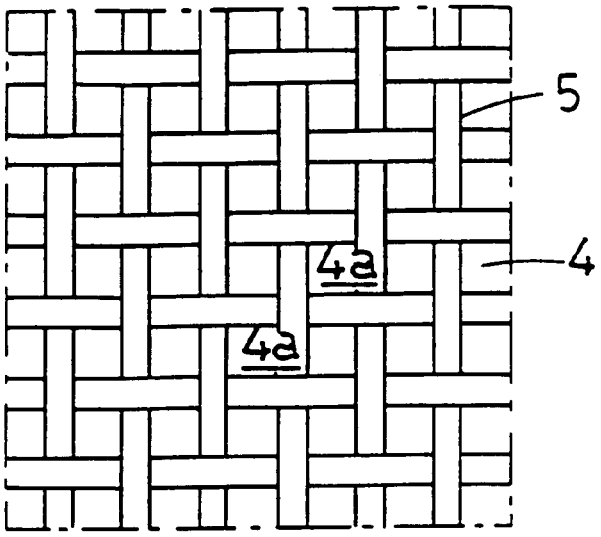
FIG. 8 is an enlarged plan view of a part of a cleaning tape of another embodiment.

From the viewpoint that the elasticity in the thicknesswise direction is produced particularly by intersecting parts of the fibers, it is preferable that the porous screen 5 is formed by the knitted fabric as shown in FIG. 5. The materials which may be used for the porous screen include polypropylene, Tetron and mixtures thereof, in addition to the polyester fibers mentioned above. In place of the knitted fabric by plain knitting as mentioned above, a woven fabric by plain weave as shown in FIG. 8, a non-woven fabric, paper, or a plastic net may be used for the porous screen 5.

With this constructed cleaning tape, when the transporting surfaces of the transporting rollers 2*a* or 2*b* contact with the porous screen 5, for example, if the contact pressure is substantially zero, the porous screen 5 protruding from the surface of the adhesive layer 4 allows the transporting rollers 2*a* or 2*b* to be prevented from contacting with the exposed surfaces 4*a* of the adhesive layer. The cleaning tape will then show substantially non-tackiness. It is noted here that the expression of "substantially non-tackiness" or "substantially non-tacky" means the tackiness of such a level that when a man lightly contacts the cleaning tape with his finger, he won't feel any tack.

Figure 7:
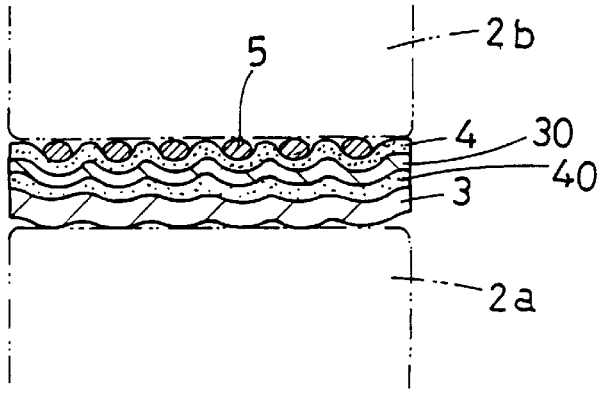
FIG. 7 is an enlarged sectional view of a part of the cleaning tape in the state of being pressurized by paired transporting rollers.

On the other hand, when the transporting surfaces of the transporting rollers 2*a*, 2*b* contact with the porous screen 5 with an adequately large contact pressure, the surface of the cleaning tape is put in the pressurized state, as shown in FIG. 7. The deformation of the cleaning tape causes adhesive layer 4 to emerge from the porous portions of the porous screen 5. As a result of this, the exposed surface 4*a* of the adhesive layer comes to be substantially flush with the surface of the porous screen 5 and thus comes in to contact with the transporting surfaces of the transporting rollers 2*a* or 2*b*, and the cleaning tape is then allowed to develop its tackiness.

With an excessively strong tackiness of the cleaning tape, there is a fear that the transporting surfaces of the transporting rollers 2*a*, 2*b* may be scratched by the cleaning tape or the adhesives may be transferred to the transporting rollers. Because of this, the tackiness of the cleaning tape is usually of not more than 5 kg/ 20 mm, preferably on the order of 2 kg/20 mm to 200 g/20 mm. In the illustrated embodiment, the tackiness of the cleaning tape is of 850 g/20 mm. It should be noted that the values of "tackiness" presented herein indicates the values obtained when the cleaning tape having no porous screen 5 is adhesive bonded to a stainless plate by making one reciprocating motion of a roller with a load of 2 kg and shortly thereafter is peeled away therefrom 180° at the speed of 300 mm/min. When the transporting rollers 2*a*, 2*b* arranged along the negative film transporting passageway 10 in the photographic processor are cleaned by use of the cleaning tape, the roll-in preventing portion 6 provided at one lengthwise end of the cleaning tape is first inserted in the intermediate insertion portion 11 provided at a midpoint of the transporting passageway 10. In this stage, the cleaning tape is in the non-pressurized state and thus is of substantially non-tackiness. As a result of this, the cleaning tape can be smoothly inserted without adhering to the insertion portion 11.

Figure 4:
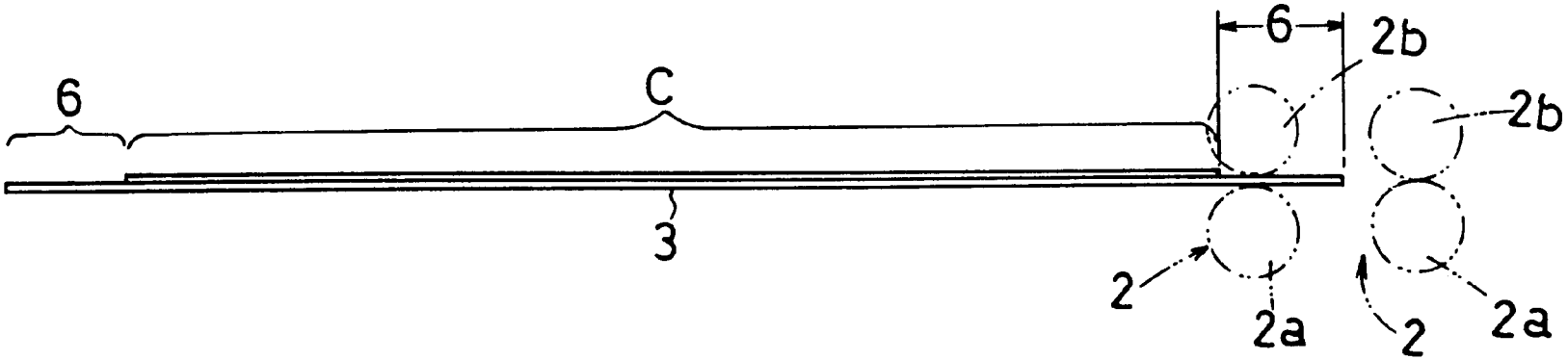
FIG. 4 is a schematic front view of the same.

Then, the inserted cleaning tape is held in sandwich relation and in the pressurized state between the transporting rollers 2*a*, 2*b* at the roll-in preventing portion 6 of the tape body 3, as schematically shown in FIG. 4, and is fed downstream from the transporting rollers 2*a*, 2*b*. The tape body 3 has such elasticity in bending as to be substantially completely restored to its original flat form against the bending and, besides, the roll-in preventing portion 6 of the tape body has no adhesive layer 4, thus allowing the roll-in preventing portion 6 to be prevented from adhering to the transporting surfaces of the transporting rollers 2*a*, 2*b*. In other words, the cleaning tape is prevented from adhering to and being rolled in the transporting rollers 2*a*, 2*b*. As a result of this, the cleaning tape is smoothly fed downstream from the paired transporting rollers 2 to the next paired transporting rollers 2.

When the cleaning tape is transported while it is held in sandwich relation between the transporting rollers 2*a*, 2*b* and in the pressurized state, the surface of the cleaning tape develops its tackiness after a portion of the tape body 3 in which the adhesive layer 4 and the porous screen 5 are provided is pressurized by both rollers 2*a*, 2*b*. Also, the transporting rollers 2*a*, 2*b*, formed of elastic material, are deformed after that point. Thus, from after the transporting surfaces of the transporting rollers 2*a* or 2*b* contact with the exposed surfaces 4*a* of the adhesive layer until they separate therefrom, contaminants such as dirt adhering on the transporting surfaces are transferred to the exposed surfaces 4*a* of the adhesive layer. By virtue of this transferring effect, the transporting surfaces are cleaned out.

In this case, when the exposed surface 4*a* of the adhesive layer and the transporting surfaces of the transporting rollers 2*a* or 2*b* are separated from each other, the exposed surfaces 4*a* are held at their peripheries against a tensile force acting on the interfaces therebetween by circumferences of meshes of the porous screen 5. As a result, a tensile stress acting on the tacky interface between the exposed surfaces 4*a* of the adhesive layer and the tape body 3 is reduced that amount. As a result of this, the exposed surfaces 4*a* of the adhesive layer can well be prevented from being separated from the tape body 3 and transferred to the transporting rollers 2*a* or 2*b* (the so-called "transference of adhesives").

When the cleaning tape is released from pressurization by the paired transporting rollers 2, the tape body 3, the adhesive layer 4 and the porous screen 5 are restored to their original forms. Then, the porous screen 5 protrudes from the exposed surfaces 4*a* of the adhesive layer again to come to substantial, "non-tackiness" again. As a result of this, even when the cleaning tape contacts with the guide member or something within the transporting passageway 10, the tape is prevented from adhering to the guide member or something.

Figure 9:
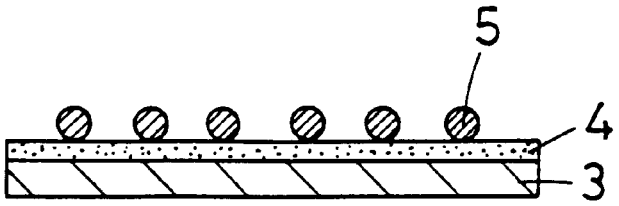
FIG. 9 is an enlarged sectional view of a part of a cleaning tape of another embodiment.

It is to be understood that the invention is not limited to the illustrated embodiment in which the adhesive layers 4, 40 are formed on the front and rear surfaces of the tape-like sheet 30, respectively, and the porous screen 5 is laid on the adhesive layer 4 at the front side of the sheet so that the sheet 30 can be allowed to adhere on one side of the tape body 3 through the adhesive layer 40. For example, the invention may be modified such that the adhesive layer 4 is formed directly on the front surface of the tape body 3 and the porous screen 5 is laid on the surface of the adhesive layer 4, as shown in FIG. 9.

Figure 10:
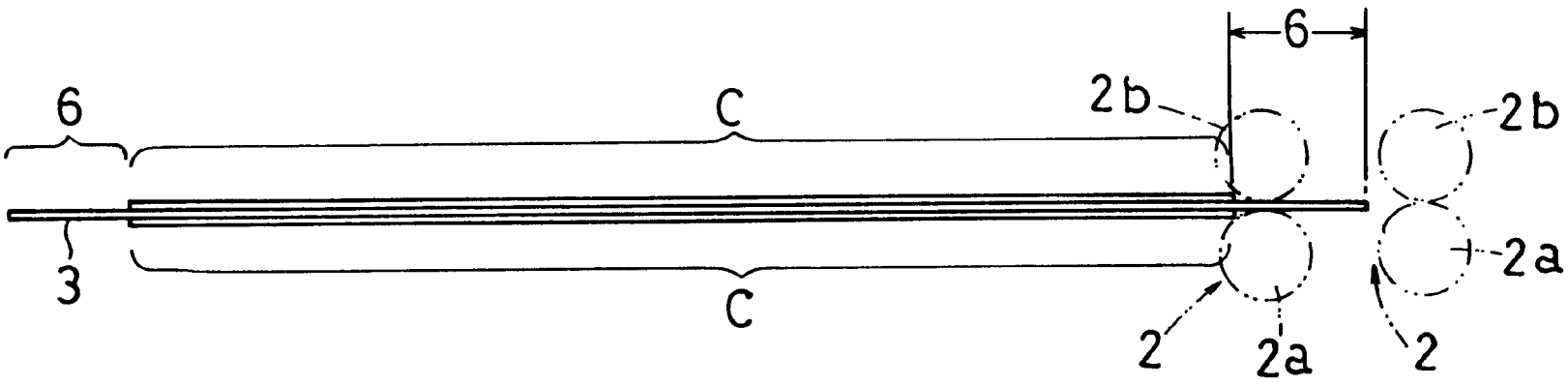
FIG. 10 is a schematic front view of a cleaning tape of still another embodiment.

Also, the cleaning portion C composed of the adhesive layer 4 and the porous screen 5, which in illustration is formed on one side of the tape body 3 only, may be formed on both sides of the tape body 3, as schematically shown in FIG. 10. This modification can provide the effect of cleaning out the transporting rollers 2*a*, 2*b* of each pair of the paired transporting rollers 2 simultaneously.

The roll-in preventing portion 6, which in illustration is arranged at both lengthwise end portions of the tape body 3, may be arranged only at one lengthwise end portion of the tape body 3.

Synthetic rubber adhesives (in which 150 parts by weight of tackifier (MARUKAREZ H700M available from Maruzen Petrochemical Co., Ltd.) is mixed, with a solids content of 100 parts by weight, in 50 weight % of toluene solution of styrene-isoprene-styrene polymers (KRATON 1107 available from Shell Chemical Co., Ltd.), and further 3 parts by weight of aging prevention agent is added to the mixture) may be used as an adhesive for forming the adhesive layer 4.

What is claimed is:

1. A cleaning tape for use in cleaning transporting surfaces of photographic material transporting rollers arranged along a photographic material transporting passageway, said cleaning tape comprising:

a tape body;

an adhesive layer on at least one side of said tape body and spaced from one lengthwise end of said tape body; and a porous screen provided on a surface of said adhesive layer on said tape body forming a structure such that if a surface of a portion of said tape body, having said adhesive layer thereon, is in a non-pressurized state, being non-pressurized by the transporting rollers along the photographic material transporting passage way, said porous screen protrudes from said surface of the adhesive layer so that the cleaning tape is substantially non-tacky, and such that if the surface of the portion of said tape body having said adhesive layer thereon is in a pressurized state due to being passed between the transporting rollers along the photographic material passageway, said adhesive layer emerges from porous portions of said porous screen so that the cleaning tape is substantially tacky.

2. The cleaning tape of claim 1, wherein said adhesive layer has a length at least as long as the circumference of the transporting rollers.

3. The cleaning tape of claim 2, wherein a ratio of an area S1 of exposed surfaces of said adhesive layer in said porous portions of said porous screen to an area S2 of covered surfaces of said adhesive layer covered by said porous screen is in a range of 50/1 to 1/10.

4. The cleaning tape of claim 1, wherein a ratio of an area S1 of exposed surfaces of said adhesive layer in said porous portions of said porous screen to an area S2 of covered surfaces of said adhesive layer covered by said porous screen is in a range of 50/1 to 1/10.

* * * * *